US010863594B2

(12) United States Patent
Perez-Bolivar et al.

(10) Patent No.: US 10,863,594 B2
(45) Date of Patent: Dec. 8, 2020

(54) LIGHTING DEVICE USING WIRELESS POWER TRANSFER MODULE

(71) Applicant: Grote Industries, LLC, Madison, IN (US)

(72) Inventors: Cesar Perez-Bolivar, Madison, IN (US); Andrew Worley, Madison, IN (US); Adam Slade, Madison, IN (US); Peter Thompson, Madison, IN (US); Paul Miller, Borden, IN (US); Sankalp Pampattiwar, Madison, IN (US)

(73) Assignee: Grote Industries, LLC, Madison, IN (US)

( * ) Notice: Subject to any disclaimer, the term of this patent is extended or adjusted under 35 U.S.C. 154(b) by 0 days.

(21) Appl. No.: 15/639,502

(22) Filed: Jun. 30, 2017

(65) Prior Publication Data

US 2018/0020513 A1 Jan. 18, 2018

Related U.S. Application Data

(60) Provisional application No. 62/362,162, filed on Jul. 14, 2016.

(51) Int. Cl.

| | |
|---|---|
| ***H05B 45/00*** | (2020.01) |
| ***H05B 47/19*** | (2020.01) |
| ***H01F 27/28*** | (2006.01) |
| ***H01F 27/36*** | (2006.01) |
| ***H01F 38/14*** | (2006.01) |

(52) U.S. Cl.

CPC ..... *H05B 45/00* (2020.01); *H01F 27/2804* (2013.01); *H01F 27/36* (2013.01); *H01F 38/14* (2013.01); *H05B 47/19* (2020.01)

(58) Field of Classification Search

CPC .. H05B 37/0272; H05B 33/0806; H01F 38/14
USPC ..... 315/283, 292
See application file for complete search history.

(56) References Cited

U.S. PATENT DOCUMENTS

| | | | | |
|---|---|---|---|---|
| 5,264,997 | A | 11/1993 | Hutchisson et al. | |
| 5,739,592 | A | 4/1998 | Rigsby et al. | |
| 6,163,642 | A * | 12/2000 | Huppenthal | G02B 6/32 385/138 |
| 8,283,888 | B2 * | 10/2012 | Inoue | H02J 5/00 320/108 |
| 2007/0152642 | A1 | 7/2007 | Franklin | |

(Continued)

FOREIGN PATENT DOCUMENTS

WO 2015195199 A1 12/2015

OTHER PUBLICATIONS

The International Search Report and the Written Opinion of the International Searching Authority dated Sep. 14, 2017 in the corresponding PCT International Patent Application No. PCT/US2017/040427.

*Primary Examiner* — Alexander H Taningco
*Assistant Examiner* — Amy X Yang
(74) *Attorney, Agent, or Firm* — Posz Law Group, PLC

(57) ABSTRACT

A lighting device, comprising: a circuit board; a receiver coil trace located on the circuit board and configured to receive transmitted power from a transmitting coil trace; a light-emitter located on the circuit board, configured to receive power from the receiver coil trace; and receiver electronics located on the circuit board, configured to receive power from the receiver coil trace and control operation of the light emitter.

16 Claims, 13 Drawing Sheets

(56) References Cited

U.S. PATENT DOCUMENTS

| | | | | |
|---|---|---|---|---|
| 2009/0091313 | A1* | 4/2009 | Teeters | B60Q 1/1476 324/207.16 |
| 2009/0290332 | A1* | 11/2009 | Jacobs | F21V 23/02 362/183 |
| 2010/0135667 | A1 | 6/2010 | Grace | |
| 2010/0156344 | A1* | 6/2010 | Inoue | H02J 5/00 320/108 |
| 2010/0194207 | A1 | 8/2010 | Graham | |
| 2011/0074304 | A1* | 3/2011 | Honsberg-Riedl | H05B 33/0815 315/250 |
| 2011/0222272 | A1* | 9/2011 | Yeh | F21L 4/08 362/183 |
| 2012/0056751 | A1 | 3/2012 | Field | |
| 2013/0026504 | A1* | 1/2013 | Marx | F21K 9/00 257/88 |
| 2014/0340877 | A1* | 11/2014 | Nelson | G09F 21/02 362/103 |
| 2015/0298599 | A1* | 10/2015 | Ito | B60Q 1/2696 362/543 |

* cited by examiner

LIGHTING DEVICE USING WIRELESS POWER TRANSFER MODULE

CROSS-REFERENCE TO RELATED APPLICATION

This application claims the benefit of U.S. Provisional Application No. 62/362,162 filed Jul. 14, 2016, which is expressly incorporated herein by reference.

FIELD OF THE INVENTION

This disclosure relates to a wireless power transfer module that facilitates power transfer without the use of cables. In particular it relates to a lighting device that operates using such a wireless power transfer module.

BACKGROUND OF THE INVENTION

Wireless Power Transfer facilitates power transfer without the use of cables. Most lighting applications require the lamps to be low profile and with exterior lighting applications being waterproof. Many existing exterior lighting products have issues with water leakage due to the holes required to run power cables.

It would therefore be desirable to provide a means of powering a lighting application (e.g., one using a light emitting element) wirelessly so that a hole is not required in a cab wall to pass a power cable.

One solution to these problems is the use of wireless Power Transfer with low profile LED strips; another is to use low-power-consumption lamps.

The major roadblock in utilizing the wireless power transfer in such applications is the associated cost. With a single substrate design the cost can be lowered significantly.

This design also facilitates the EMI shielding of electronics using a ferrite sheet or ferrite coating on the back of the substrate.

This design also facilitates using AC power directly to power AC light-emitter (e.g., LED) light strips or AC low power consumption lamps. This further reduces the electronics cost as it does not require any AC to DC conversion as shown in U.S. Pat. No. 9,087,973 for Egress and/or flicker-free lighting device with persistent luminescence, issued on Jul. 21, 2015.

SUMMARY OF THE INVENTION

A lighting device is provided, comprising: a circuit board; a receiver coil trace located on the circuit board and configured to receive transmitted power from a transmitting coil trace; a light-emitter located on the circuit board, configured to receive power from the receiver coil trace; and receiver electronics located on the circuit board, configured to receive power from the receiver coil trace and control operation of the light emitter.

The light emitter may be located on a first surface of the circuit board, and the receiver coil trace may be located on a second surface of the circuit board opposite the first surface.

The receiver electronics may be located on the first half of the first surface of the circuit.

The receiver electronics may be located on the second half of the first surface of the circuit.

The light emitter may be located on a first half of a first surface of the circuit board, the receiver coil trace may be located on a second half of the first surface of the circuit board, a ferrite coating may be located on first and second halves of a second surface opposite the first surface of the circuit board, and the circuit board may folded in half such that the first half of the second surface of the circuit board faces the second half of the second surface of the circuit board, the first half of the first surface of the circuit board faces in a first direction, and the second half of the first surface of the circuit board faces in a second direction opposite the first direction.

The receiver electronics may be located on the first half of the first surface of the circuit.

The receiver electronics may be located on the second half of the first surface of the circuit.

The light emitter may be a light-emitting diode.

The receiver coil trace may receive AC power.

A lighting device is provided, comprising: a transmitter circuit board; a transmitter coil trace located on the transmitter circuit board; a receiver circuit board; a receiver coil trace located on the receiver circuit board and configured to receive transmitted power from the transmitting coil trace; a light-emitter located on the receiver circuit board, configured to receive power from the receiver coil trace; receiver electronics located on the receiver circuit board, configured to receive power from the receiver coil trace and control operation of the light emitter; and a cab wall located between the transmitter circuit board and the receiver circuit board, the cab wall being unbroken and unpierced.

The device may further comprise a transmitter housing configured to affix the transmitter circuit board to the cab wall.

The device may further comprise an affixing material configured to secure the receiver circuit board to the cab wall.

DESCRIPTION OF THE DRAWINGS

The accompanying figures where like reference numerals refer to identical or functionally similar elements and which together with the detailed description below are incorporated in and form part of the specification, serve to further illustrate an exemplary embodiment and to explain various principles and advantages in accordance with the present invention.

DETAILED DESCRIPTION

The instant disclosure is provided to further explain in an enabling fashion the best modes of performing one or more embodiments of the present invention. The disclosure is further offered to enhance an understanding and appreciation for the inventive principles and advantages thereof, rather than to limit in any manner the invention. The invention is defined solely by the appended claims including any amendments made during the pendency of this application and all equivalents of those claims as issued.

It is further understood that the use of relational terms such as first and second, and the like, if any, are used solely to distinguish one from another entity, item, or action without necessarily requiring or implying any actual such relationship or order between such entities, items or actions. It is noted that some embodiments may include a plurality of processes or steps, which can be performed in any order, unless expressly and necessarily limited to a particular order; i.e., processes or steps that are not so limited may be performed in any order.

A wireless Power Transfer system is provided with integrated receiver modules consisting of the receiver coil trace with ferrite shielding, receiver electronics and light emitters mounted on a single substrate. The design aims at significantly lowering the cost of the receiver assembly while providing a waterproof solution.

A single foldable substrate is provided with electronics and a light-emitting element (e.g., an LED) on one half and ferrite shielding and receiver coil trace on another. The design makes it easy for production and is cost effective.

Figure 1:
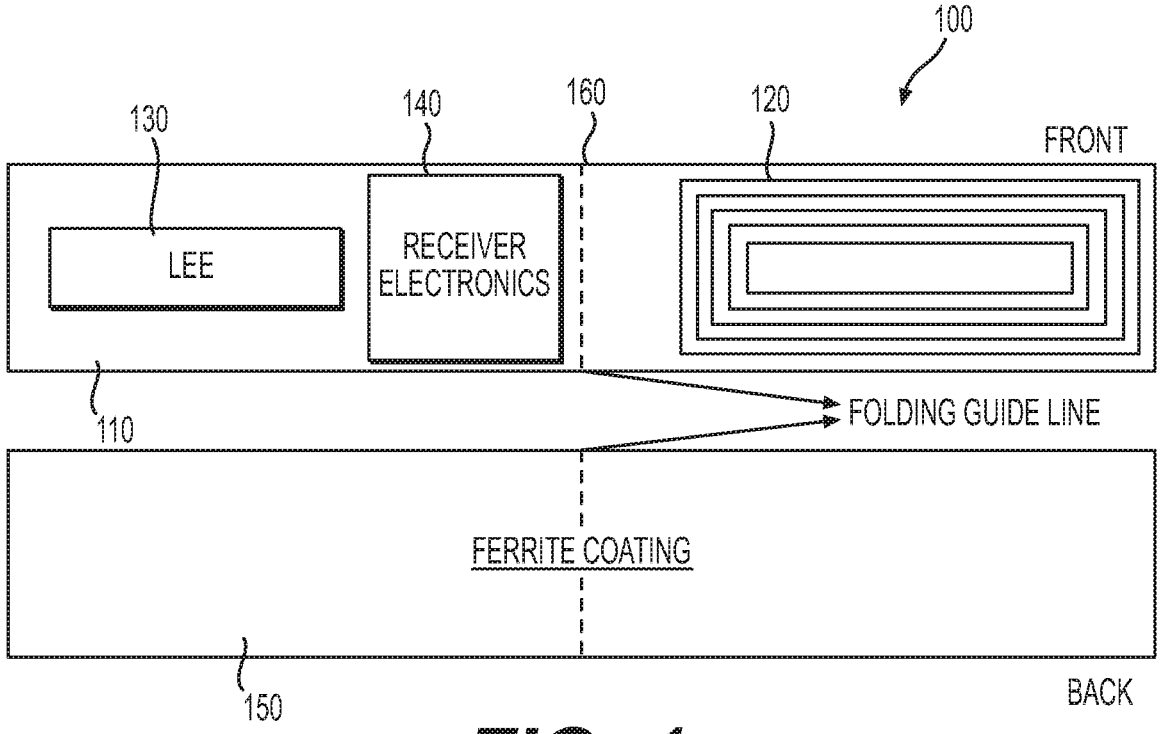
FIG. 1 is a diagram of the front and back of an unfolded lighting device according to a disclosed embodiment.

FIG. 1 is a diagram of the front and back of an unfolded lighting device 100 according to a disclosed embodiment. As shown in FIG. 1, the lighting device 100 includes a substrate 110, a receiver coil trace 120, a light-emitting element (i.e., a light emitter) 130, receiver electronics 140, and a ferrite coating layer 150.

The substrate 110 is split into two halves with a folding guideline 160 in the middle. In various embodiments, the substrate 110 can be a flexible substrate, a circuit board, or any desirable substrate.

The receiver coil trace 120 is formed on a first half of the substrate 110 and operates to receive power from a transmitter coil (not shown).

The light emitting element 130 is formed on a second half of the substrate 110, receives power from the receiver coil 120, and is controlled by the receiver electronics 140 to generate light. The light-emitting element can be a light-emitting diode, or any other device for generating light. In one particular embodiment, the light-emitting element is a flip-chip light-emitting element.

The receiver electronics 140 receive power from the receiver coil trace 120, and control operation of the light-emitting element 130.

The ferrite coating layer 150 is formed on an opposite side of the substrate 110 from the receiver coil trace 120, the light-emitting element 130, and the receiver electronics 140. The ferrite coating layer 150 on the back of the substrate 110 protects the receiver electronics 140 and light-emitting element 130 from any possible interference from the high frequency AC of wireless power transfer when the substrate 110 is folded.

The substrate 110 can be folded in half along the folding guideline 160.

Figure 2:
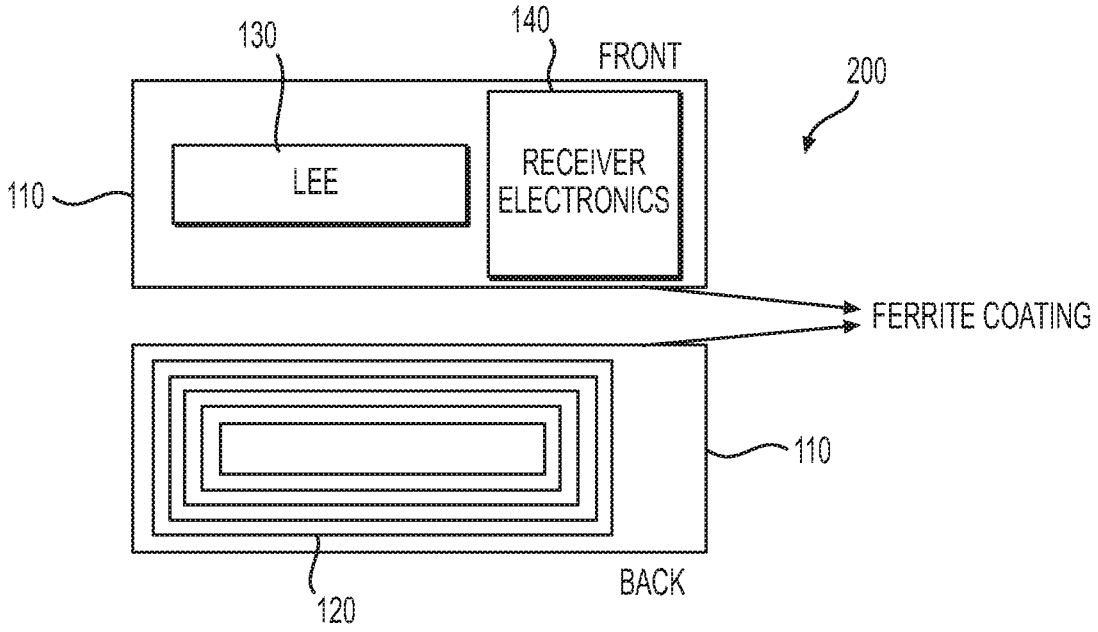
FIG. 2 is a diagram of the front and back of a folded lighting device according to a disclosed embodiment.

FIG. 2 is a diagram of the front and back of a folded lighting device 200 according to a disclosed embodiment. This is the device of FIG. 1 in a folded configuration. As shown in FIG. 2, now that the device has been folded, the side of the substrate 110 with the ferrite coating is not seen; the first half of the first side of the substrate 110 forms a front of the folded circuit board; and the second half of the first side of the substrate 110 forms a back of the folded lighting device 200.

Thus, the light-emitting element 130 and the receiver electronics 140 are located on an opposite side of the substrate 110 from the receiver coil trace 120. This allows the ferrite coating layer 150 to protect the light-emitting element 130 and the receiver electronics 140 from interference from the receiver coil trace 120.

Figure 3:
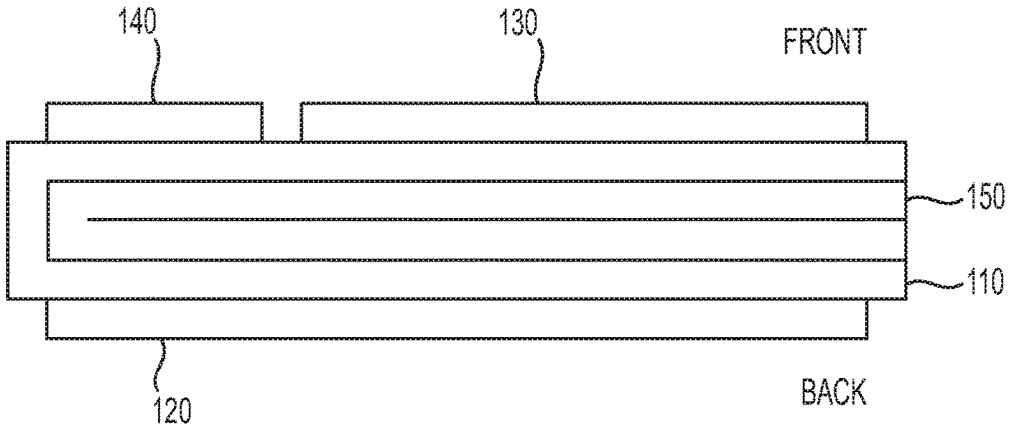
FIG. 3 is a side view of the folded lighting device of FIG. 2 according to a disclosed embodiment.

FIG. 3 is a side view of the folded lighting device 200 according to a disclosed embodiment. As shown in FIG. 3, the substrate 110 is folded in half such that the ferrite coating layer 150 faces itself and provides a double thickness layer between the front and back of the folded lighting device 200. The receiver coil trace 120 is formed on the back of the folded lighting device 200, and the light-emitting element 130 and the receiver electronics 140 are formed on the front of the folded lighting device 200

Figure 4:
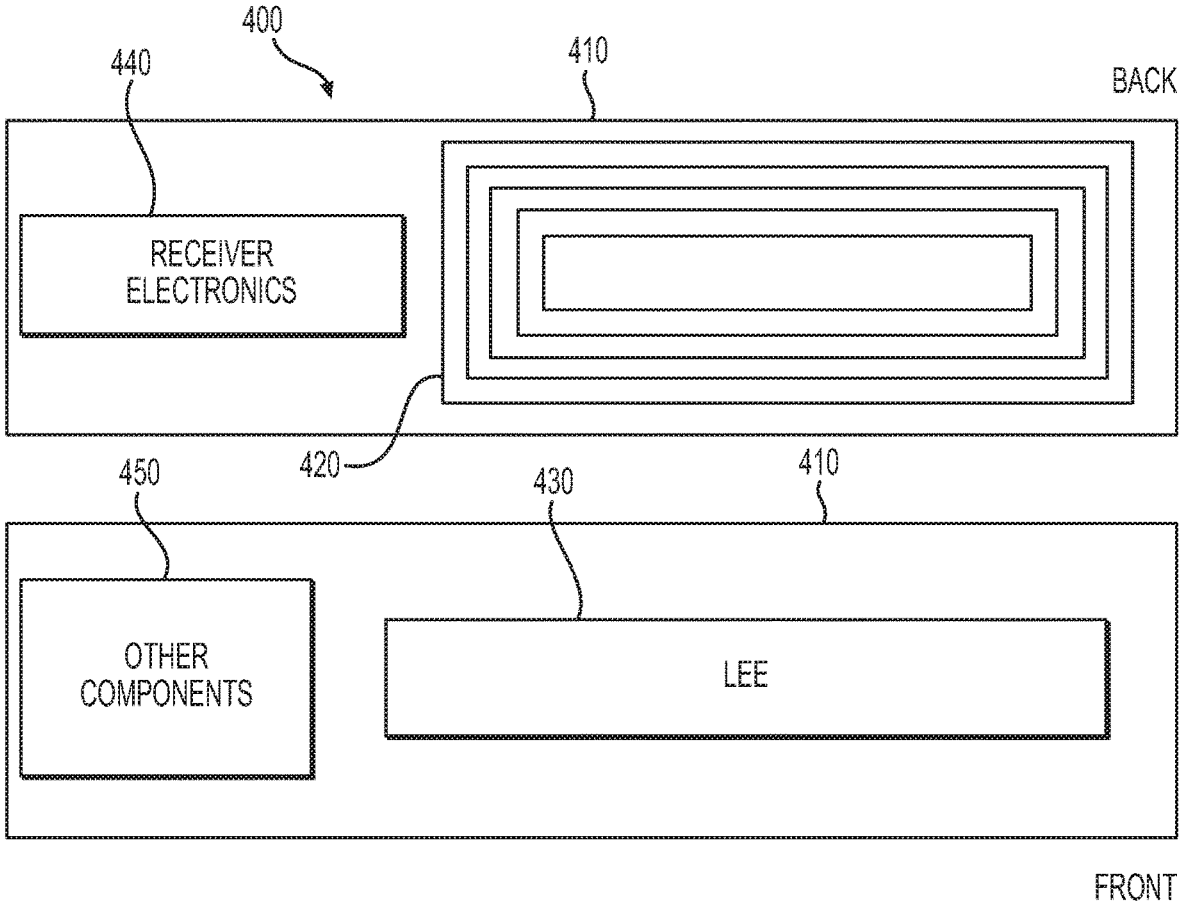
FIG. 4 is a lighting device according to another disclosed embodiment.

FIG. 4 is a lighting device 400 according to another disclosed embodiment. As shown in FIG. 4, both a receiver coil trace 420 and receiver electronics 440 are formed on one side of a substrate 410 (which may be a flexible substrate), while a light-emitting element (LEE) 430 and other components 450 are formed on the other side of the substrate 410. Although not shown, a ferrite coating layer may be formed between the front and back of this design, as with the embodiment of FIGS. 2 and 3.

Figure 5:
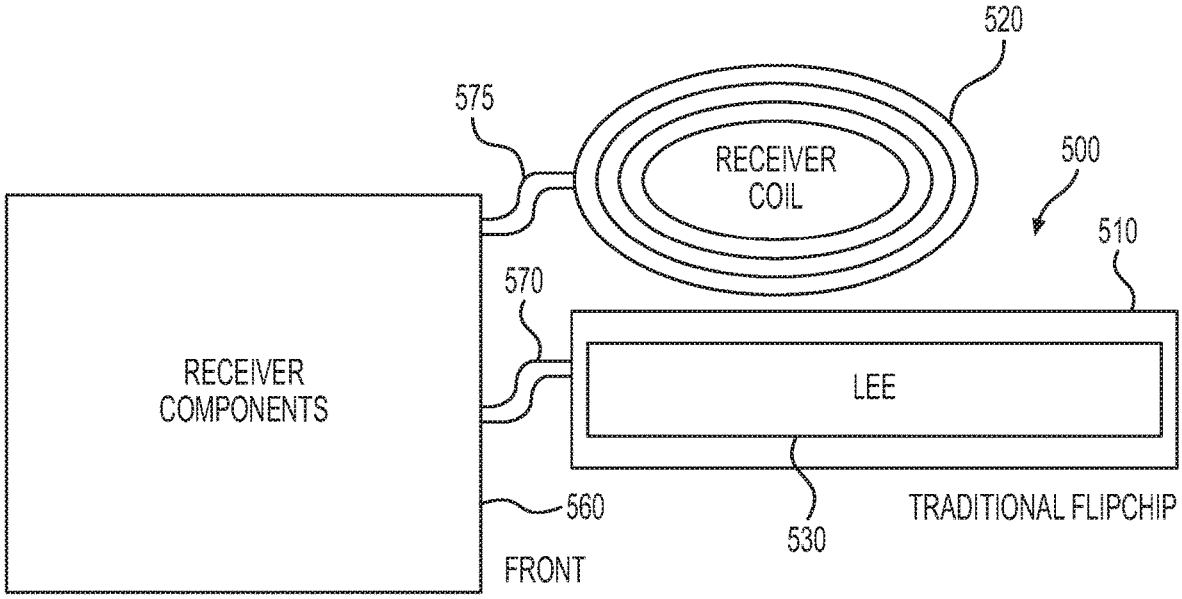
FIG. 5 shows a lighting device according to yet another disclosed embodiment.

FIG. 5 shows a lighting device 500 according to yet another disclosed embodiment. As shown in FIG. 5, a receiver coil 520, a light-emitting element 530, and receiver components 560 are all provided separate from each other, and are connected by wire 570, 575. The receiver components 560 receive power from the receiver coil 520 and may provide power and control signals to the light-emitting element 530. The receiver components 560 include receiver electronics and other components.

Figure 6:
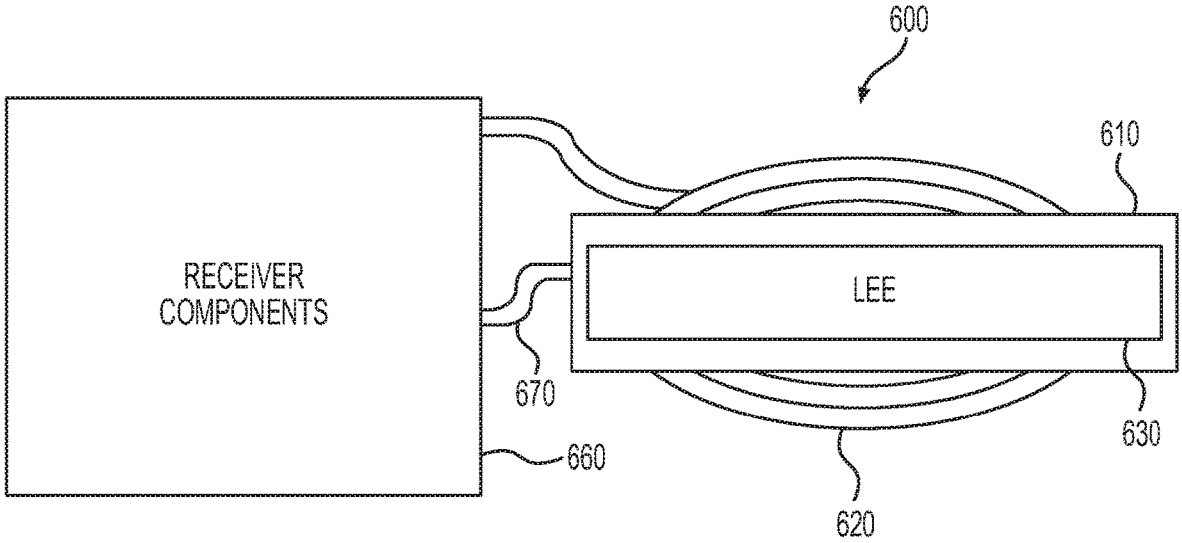
FIG. 6 is a lighting device according to still another disclosed embodiment.

FIG. 6 is a lighting device 600 according to still another disclosed embodiment. As shown in FIG. 6, a receiver coil 620 is attached to a non-light-emitting side of a substrate 610 holding a light-emitting element, while receiver components 660 are located separate from the light-emitting element 630/receiver coil 620. The receiver components 660 are connected by wire to the receiver coil 620, from which they receive power, and are also connected by wire 670 to the light-emitting element 630, to which they provide power and control signals. The receiver components 660 include receiver electronics and other components.

In alternate embodiments, the substrate 610 could be eliminated and the receiver coil 620 could be attached directly to the light-emitting element 630.

Figure 7:
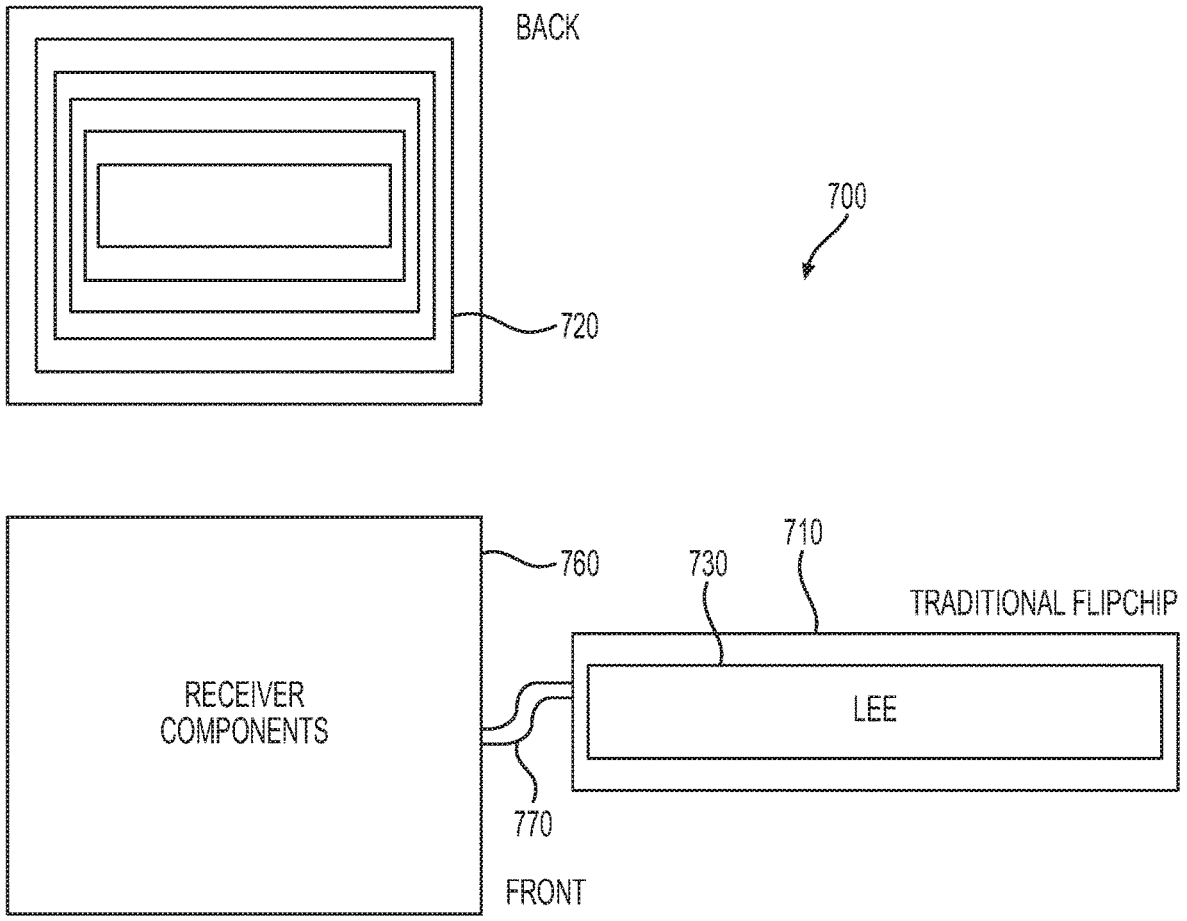
FIG. 7 is a lighting device according to yet another disclosed embodiment.

FIG. 7 is a lighting device 700 according to yet another disclosed embodiment. As shown in FIG. 7, a receiver coil 720 is formed on the opposite side of a substrate 710 (e.g., a printed circuit board) from receiver components 760. These receiver components 760 receive power from the receiver coil 720, and are connected by wire 770 to the light emitting element 730, to which they provide power and control signals. In this embodiment, a ferrite layer can be provided between the receiver components 760 and the receiver coil 720 in order to insulate the receiver components 760 from AC interference from the receiver coil 720. The receiver components 760 include receiver electronics and other components.

Figure 8:
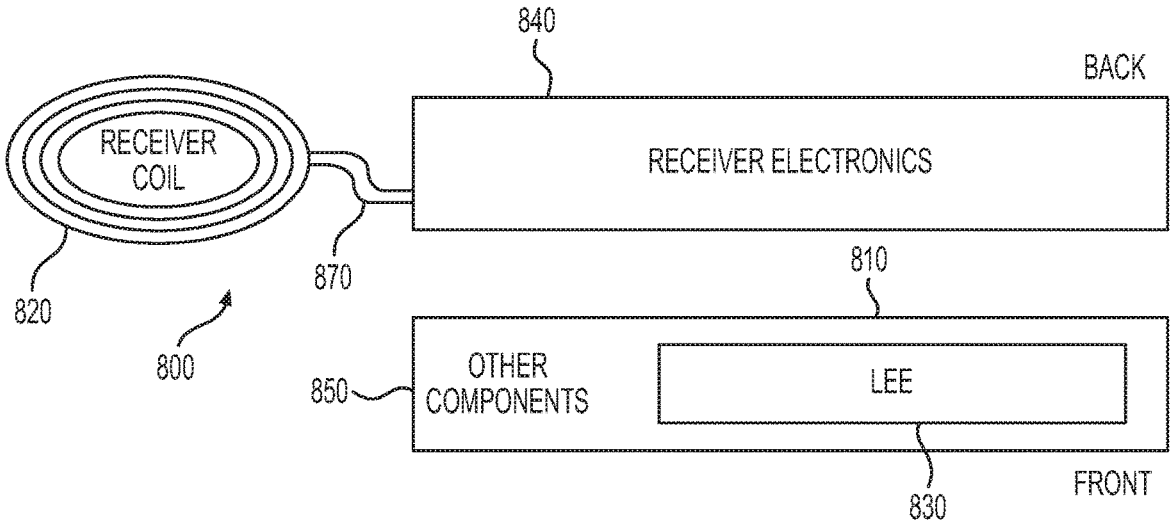
FIG. 8 is a lighting device according to still another disclosed embodiment.

FIG. 8 is a lighting device 800 according to still another disclosed embodiment. As shown in FIG. 8, receiver electronics 840 are formed on one side of a substrate 810, while a light-emitting element 830 and other components 850 are formed on a second side of the substrate 810. These other components 850 can be, for example, pick-and-place components. In addition, the substrate 810 can be a flexible substrate. The receiver electronics 850 are connected by wire 870 to a receiver coil 820; and the receiver electronics 850 are connected to the light-emitting element 830, and the other components 850, if necessary, to provide power and control signals.

Figure 9:
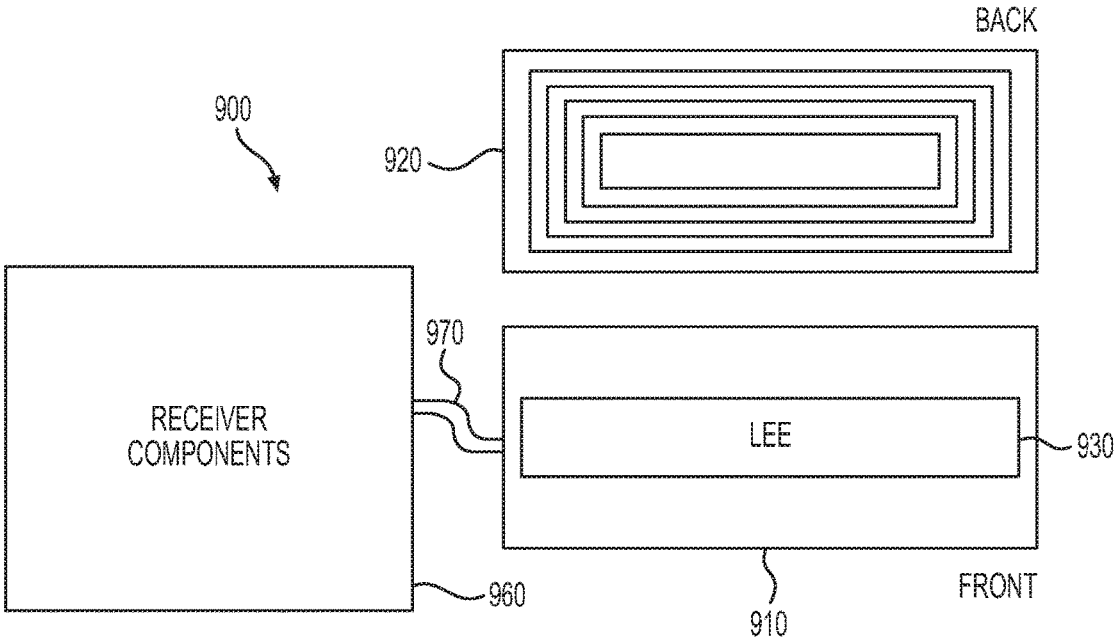
FIG. 9 is a lighting device according to another disclosed embodiment.

FIG. 9 is a lighting device 900 according to another disclosed embodiment. As shown in FIG. 9, a receiver coil 920 and a light-emitting element 930 are formed on opposite sides of a substrate 910 (e.g., a printed circuit board or a flexible substrate). The light-emitting element 930 receives power from the receiver coil 920 and is connected by wire 970 to the receiver components 960. The light-emitting element 930 provides power to the receiver components 960, while the receiver components 960 provide control signals to the light-emitting element 930. In this embodiment, a ferrite layer can be provided between the light-emitting element 930 and the receiver coil 920 in order to insulate the light-emitting element 930 from AC interference from the receiver coil 920. The receiver components 960 include receiver electronics and other components.

Figure 10:
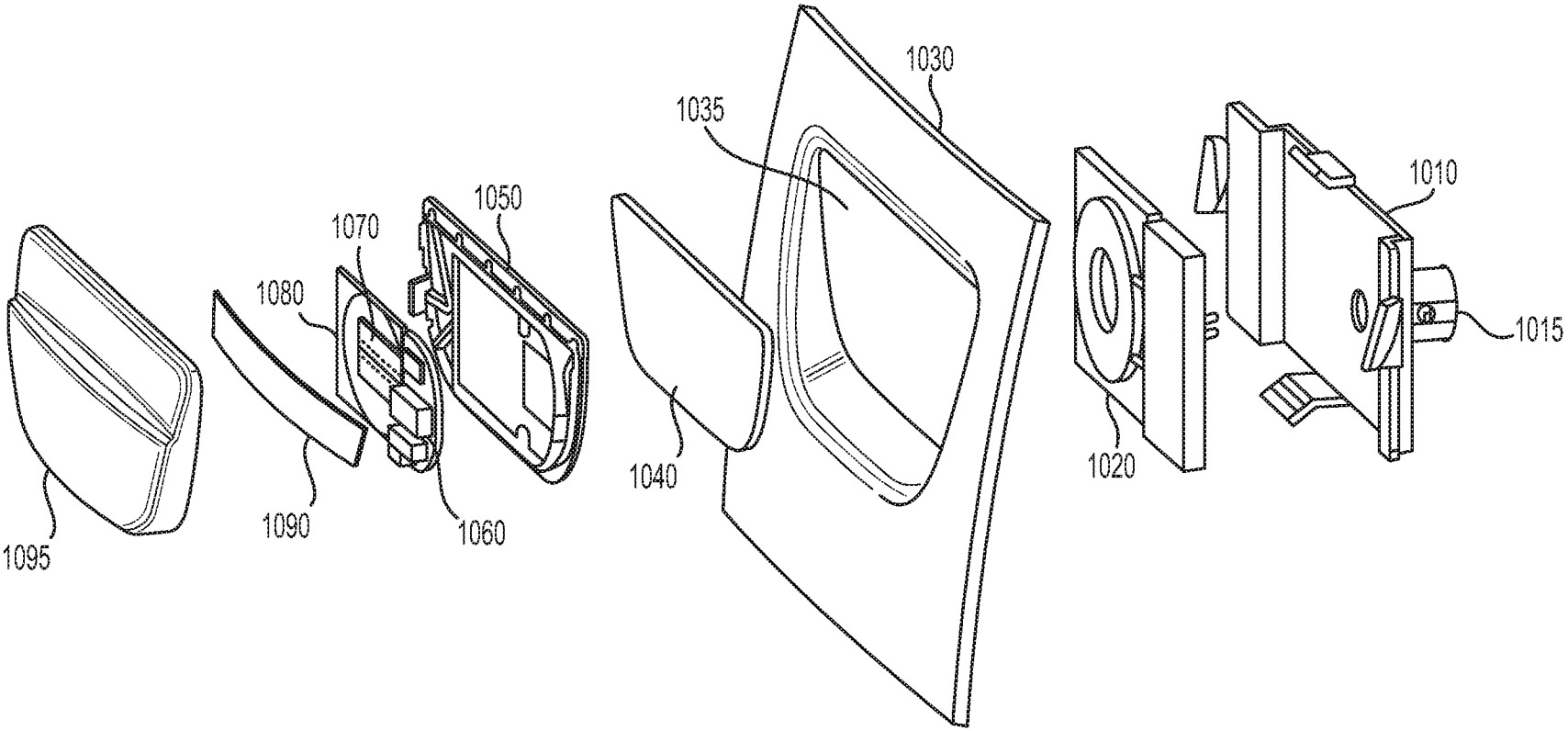
FIG. 10 is a plan view of a lighting system using a lighting device, as shown above according to disclosed embodiments.

FIG. 10 is a plan view of a lighting system 1000 using a lighting device, as shown above according to disclosed embodiments. As shown in FIG. 10, the lighting system 1000 includes a transmitter housing 1010, a transmitter board 1020, a cab wall 1030, an affixing material 1040, a lamp housing 1050, a receiver circuit 1060, a light-emitting element 1070, a receiver coil 1080, a light shaping diffuser (LSD) film 1090, and a lens 1095.

The transmitter housing 1010 operates to secure the transmitter board 1020 to the back side of the cab wall 1030. It has an opening 1015 to allow cables to pass through it.

The transmitter board 1020 operates to transmit power from a transmitter coil to the receiver coil 1080. The transmitter board 1020 can be secured to the back side of the cab wall 1030 by a securing element, such as a peel-and-stick securing element, and can also be secured in place via the transmitter housing 1010. The transmitter board 1020 will have a wire connection to an external power source (not shown).

The cab wall 1030 separates the transmitter board 1020 from the receiver coil 1080. The cab wall 1030 is preferably unbroken and unpierced to provide a good barrier to water and other substances. The cab wall 1030 preferably includes a depression 1035 configured to contain the lamp housing 1050, all of the elements attached to the lamp housing 1050, and the lens 1095.

The affixing material 1040 operates to secure the lamp housing to the front side of the cab wall 1030. It can be a peel-and-stick affixing element 1040 in some embodiments. In other embodiments a different type of glue can be used as the affixing material 1040.

The lamp housing 1050 is secured to the front side of the cab wall 1030 by the affixing material 1040, and operates to hold onto the receiver circuit 1060, light-emitting element 1070, and receiver coil 1080, securing them to the front side of the cab wall 1030.

The receiver circuit 1060 operates to control the operation of the light-emitting element 1070, and receives power from the receiver coil 1080.

The light-emitting element 1070 operates to emit light based on control signals received from the receiver circuit 1060, and receives power from the receiver coil 1080. The light-emitting element 1070 can be a light emitting diode or any device that emits light. In some embodiments it can be a flipchip LED design.

The receiver coil 1080 receives power wirelessly from a transmitter coil on the transmitter board 1020, and provides power to the receiver circuit 1060 and the light-emitting element 1070.

The receiver circuit 1060, the light-emitting element 1070, and the receiver coil 1080 can all be contained on a single receiver substrate (e.g., a circuit board). In this case, the light-emitting element 1070 and the receiver coil 1080 may be mounted on opposite sides of the receiver substrate.

The LSD film 1090 operates to clean up and shape the light from the light-emitting element 1070 into a desired format. It is secured over the light-emitting element 1070.

The lens 1095 operates to focus light from the light emitting element 1070. It is secured to the lamp housing 1050 or the cab wall 1030.

Figure 11:
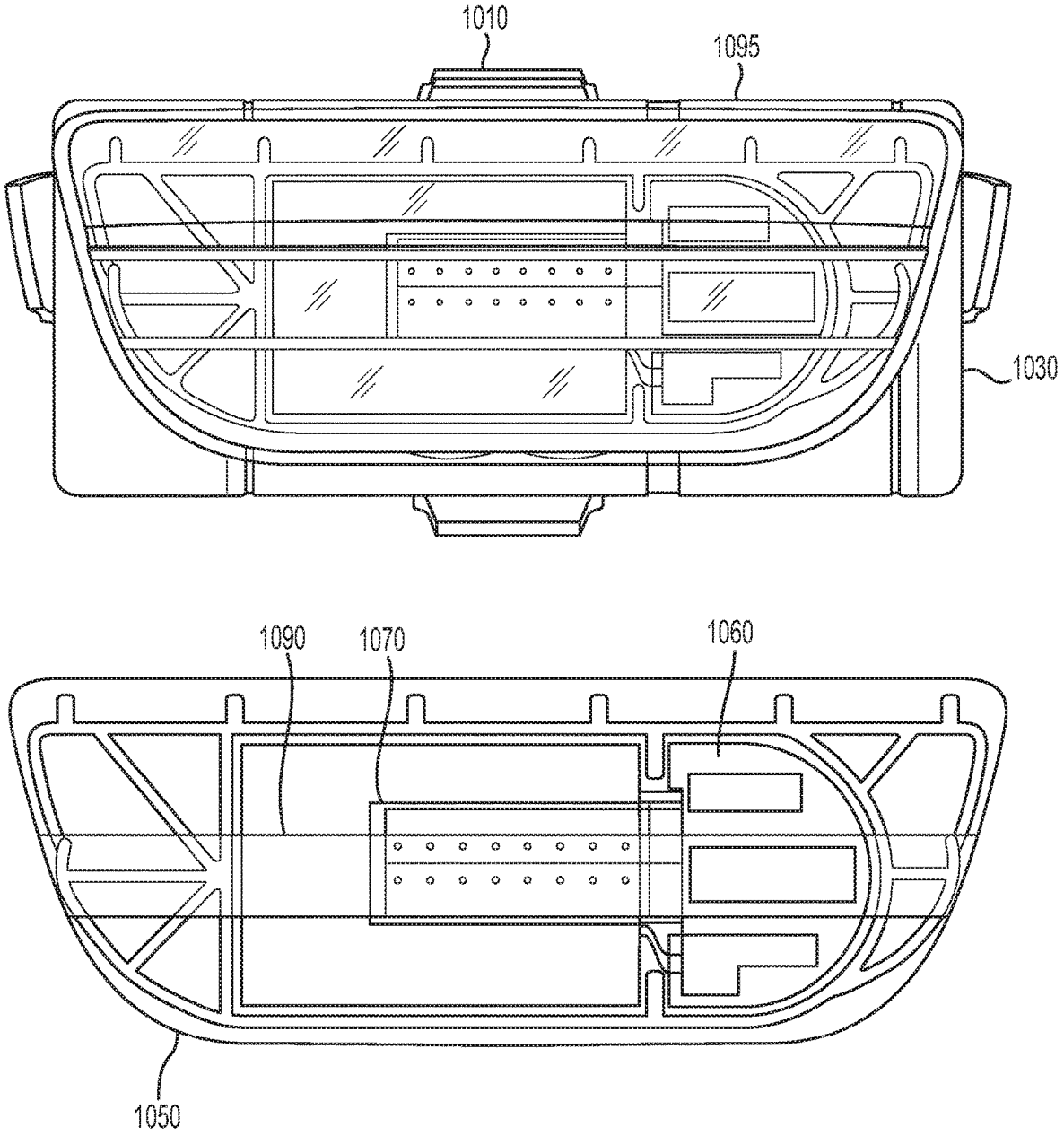
FIG. 11 is a front view of the combined system shown in FIG. 10, and a lamp housing containing a receiver circuit, a light-emitting element, a receiver coil, and an LSD film.

FIG. 11 is a front view of the combined system shown in FIG. 10, and a lamp housing 1050 containing the receiver circuit 1060, the light-emitting element 1070, the receiver coil 1080, and the LSD film 1090.

As shown in the upper portion of FIG. 11, the transmitter housing 1010 secures the transmitter board 1020 to the back of the cab wall 1030, while the combination of the affixing material 1040, the lamp housing 1050, the receiver circuit 1060, the light-emitting element 1070, the receiver coil 1080, the LSD film 1090, and the lens 1095 all fit into the depression 1035 in the front of the cab wall 1030.

As shown in the lower portion of FIG. 11, the receiver circuit 1060, the light-emitting element 1070, and the receiver coil 1080 (not shown in FIG. 11) are secured to the lamp housing 1050, and the LSD film 1090 is secured over the light-emitting element 1070. Once these elements are put together, the lamp housing 1050 can be placed into the depression 1035 in the cab wall 1030, where it is secured by the affixing material 1040.

This design is exactly similar to a wired design in terms of: (1) Distance between the LSD film and the light-emitting element; (2) Location of light-emitting element on the housing; (3) Lamp profile and thickness; and (4) Optical Characteristics. However, (a) it has no holes in the cab wall 1030, (b) PCB Trace is soldered directly to light-emitting element; (c) No mechanical terminals are required as used for wired design for light-emitting element; (d) The blank section of light-emitting element behind the receiver circuit board provides more room for the electronic components; and (e) Clips are provided on the transmitter housing to put over the bracket and reduce the misalignment margin.

In alternate embodiments, more space can be provided for the receiver circuit.

In alternate embodiments, universal light-emitting element design can be used to suit multiple vehicle applications.

Figure 12:
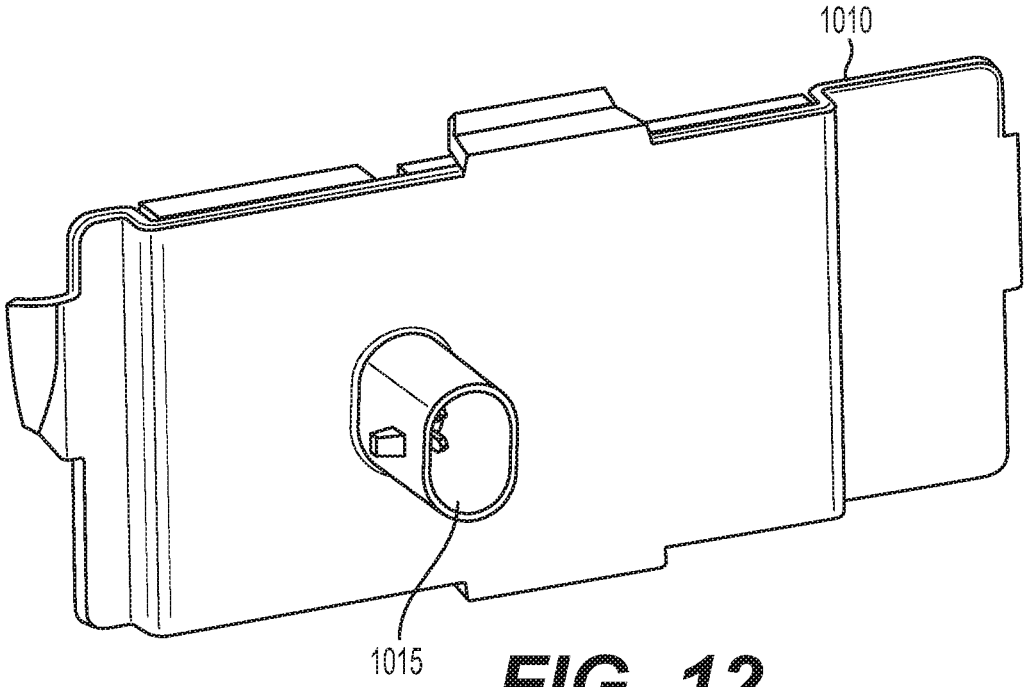
FIG. 12 is a view a back of the transmitter housing of FIG. 10.

FIG. 12 is a view a back of the transmitter housing 1010 of FIG. 10. As shown in FIG. 12, the transmitter housing 1010 has an opening 1015 so that the transmitter board can be connected by a wire passing through the opening 1015 in the transmitter housing 1010 to an external power source (not shown).

Figure 13:
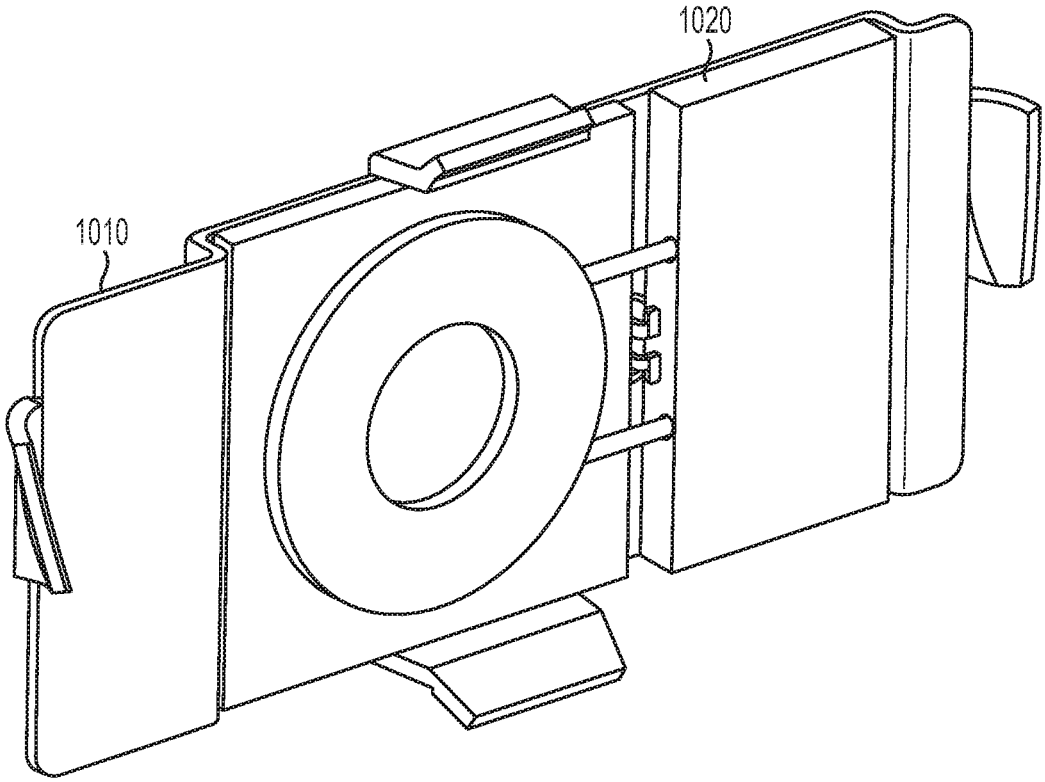
FIG. 13 is a view of a front of the transmitter housing of FIG. 10.

FIG. 13 is a view of a front of the transmitter housing 1010 of FIG. 10. As shown in FIG. 13, the transmitter board 1020 is placed into the transmitter housing 1010 such that wires from the transmitter board 1020 can extend through the opening 1015 and connect to the external power source.

Figure 14:
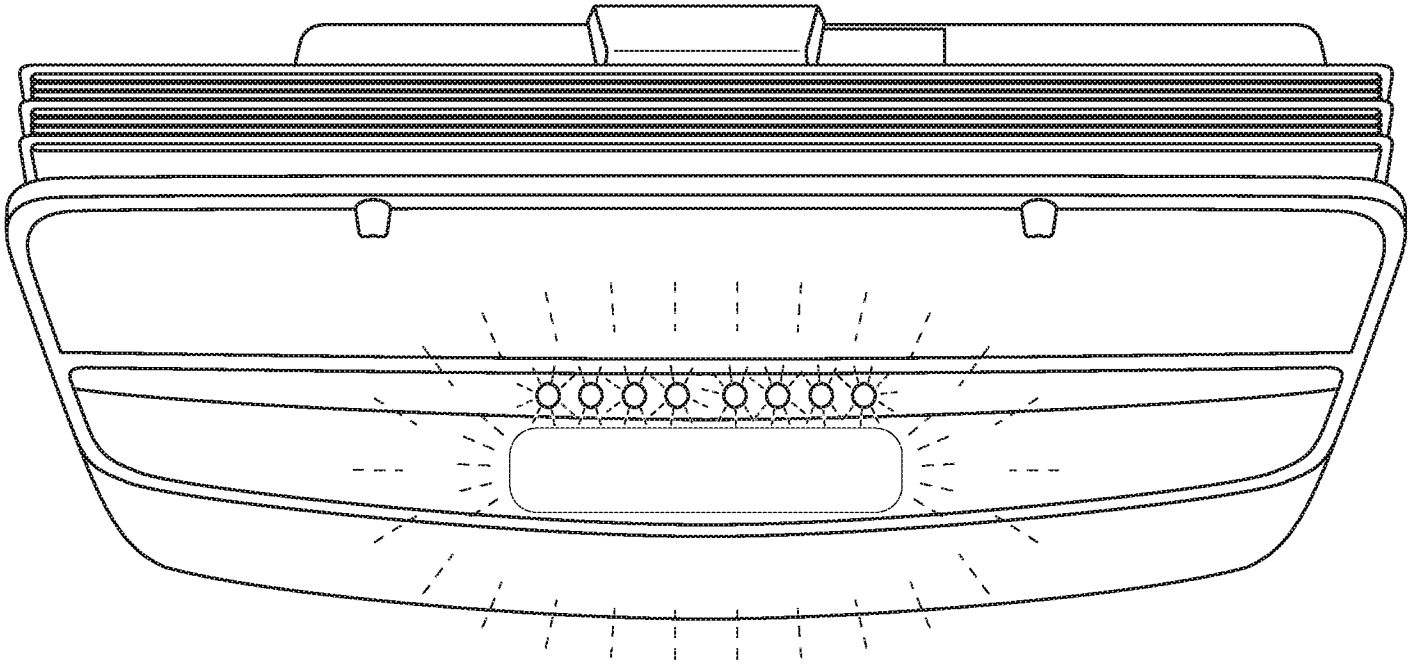
FIG. 14 is an illustration of the system used to perform a preliminary test of a lighting system.

Such a device has been preliminarily tested with a Transmitter and Receiver mounted on existing cab roof. FIG. 14 is an illustration of the system used to perform this test. The actual cab roof has a thickness between 3.5 mm-6.5 mm depending on the vehicle model. This device was designed for a thickness of 8 mm (for the added thickness of the housings). The thickness of the sample tested was ~4.5 mm (Thickest part of the sample—Non Pocket but same material). The actual working condition was modeled by adding a 4 mm thick plastic sheet. As a result, the total transmission thickness was ~8.5 mm.

The results of this test were that conductive coils will light a light-emitting element when separated by 8.5 mm thick material.

It should be noted that this example should be in no way limiting to the possible embodiments. Higher or lower transmission thicknesses can be used. The device is designed for maximum transmission power.

There was no visible impact on power transmission due to conductive primer.

Figure 15:
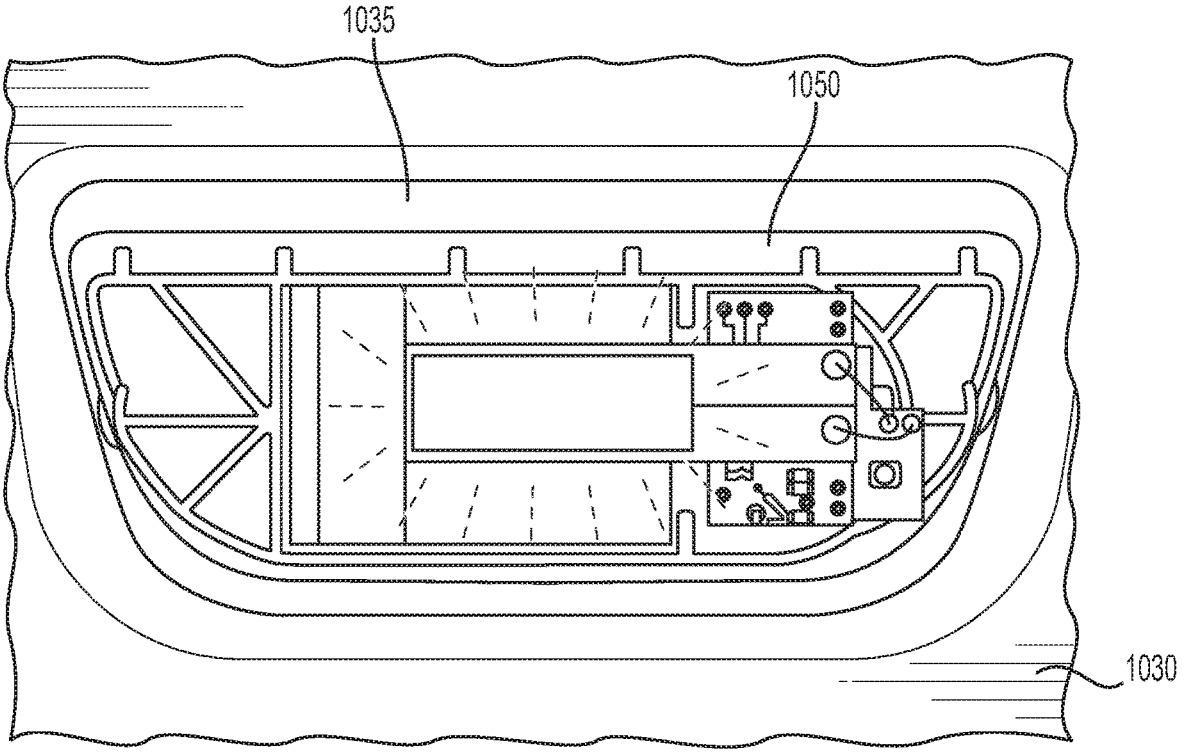
FIG. 15 is a top view of a lamp housing in a depression of a cab wall.
Figure 16:
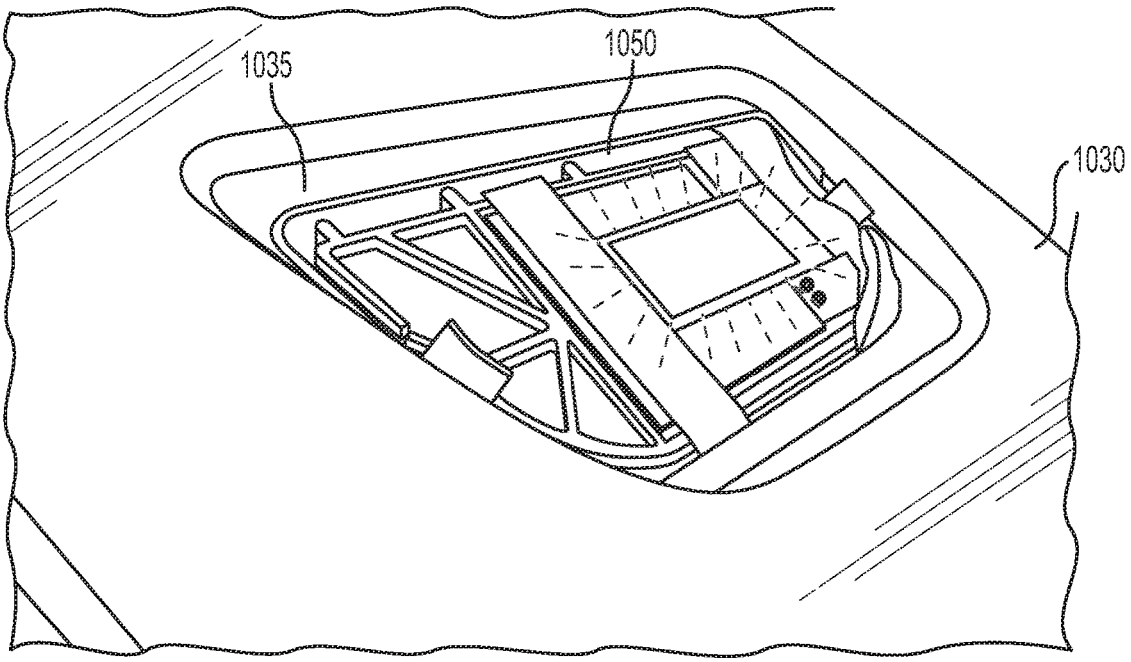
FIG. 16 is a plan view of the lamp housing of FIG. 15 in the depression of the cab wall 1030.

FIGS. 15 and 16 show a top view and a plan view of a lamp housing 1050 in a depression 1035 of a cab wall 1030. As shown in these drawings, the receiver circuit 1060, light-emitting element 1070, receiver coil 1080, and LSD film 1090 are attached to the lamp housing 1050. Furthermore, the lamp housing 1050 is formed such that it neatly fits within the depression 1035.

Figure 17:
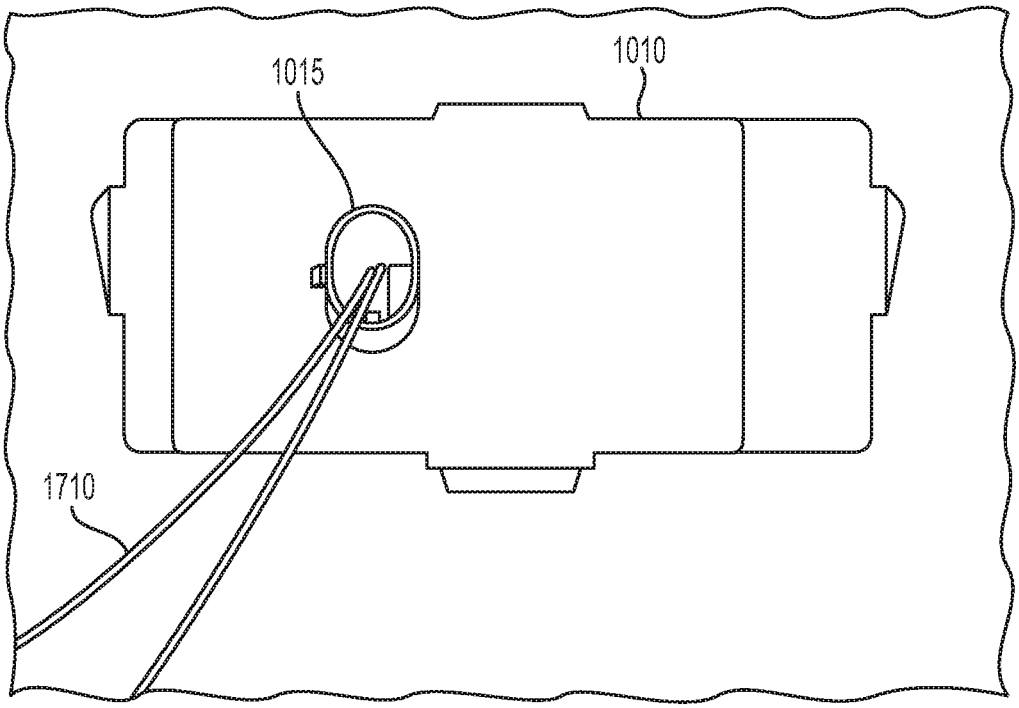
FIG. 17 is an illustration of a back view of a transmitter housing with a transmitter board secured inside, connected to a cab wall.

FIG. 17 is an illustration of a back view of a transmitter housing 1010 with a transmitter board secured inside, connected to a cab wall 1030. As shown in FIG. 17, wires 1710 extend out of an opening 1015 in the transmitter housing 1010. These wires 1710 are for connecting the transmitter board 1020 to an external power source (not shown).

Figure 18:
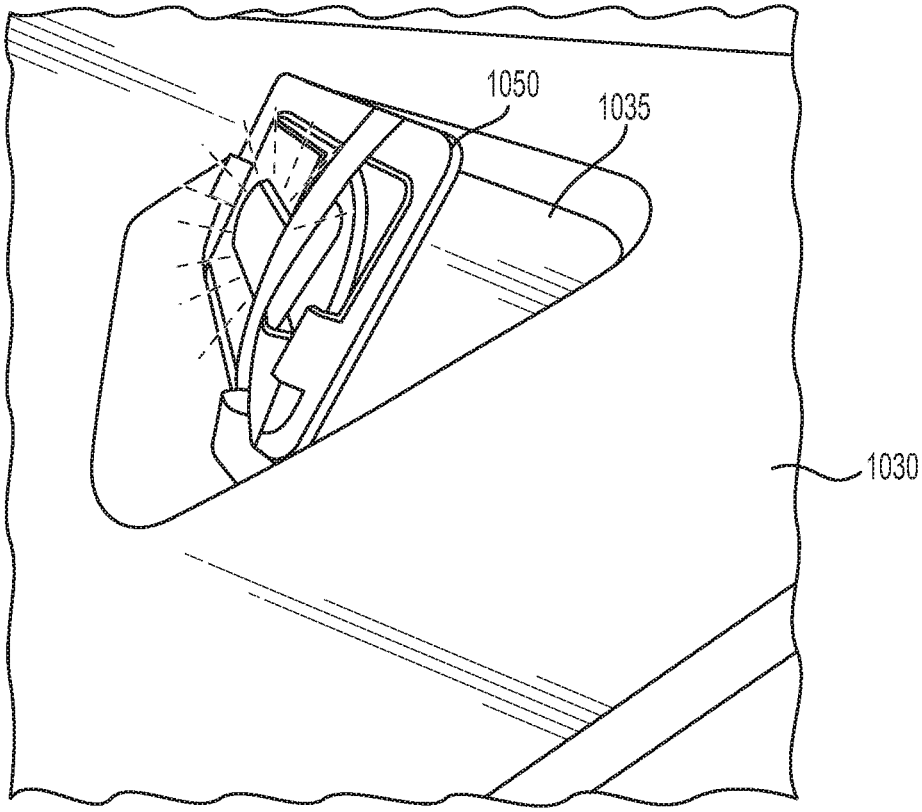
FIGS. 18-20 are plan views illustrating how a lamp housing can be moved in a Z-direction, or tilted at an angle with respect to a cab wall.
Figure 20:
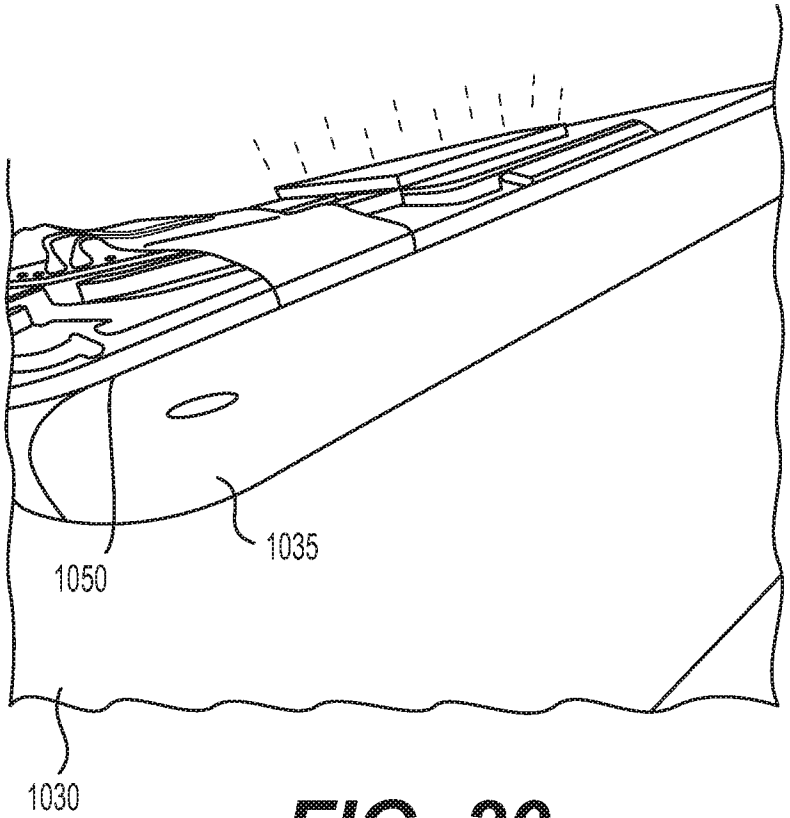
Figure 19:
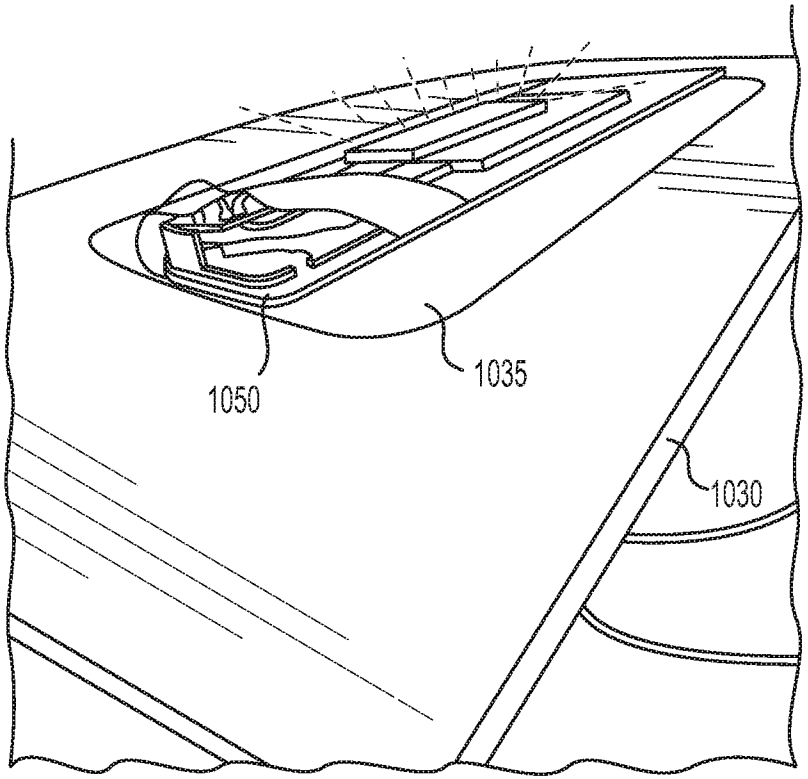

FIGS. 18-20 illustrate how the lamp housing 1050 can be moved in a Z direction, or tilted at an angle with respect to the cab wall 1030, and the receiver coil 1080 (and thus the light-emitting element 1070) will still receive power from the transmitter board 1020, allowing the light-emitting element 1070 to emit light. In particular, FIGS. 18 and 19 show that angular tilts are possible without interrupting power from the transmitter board 1020 to the receiver coil 1080, while FIG. 20 shows that movement in the Z direction (i.e. moving the lamp housing 1050 farther away from the front of the cab wall 1030) are also possible without interrupting power from the transmitter board 1020 to the receiver coil 1080.

Figure 21:
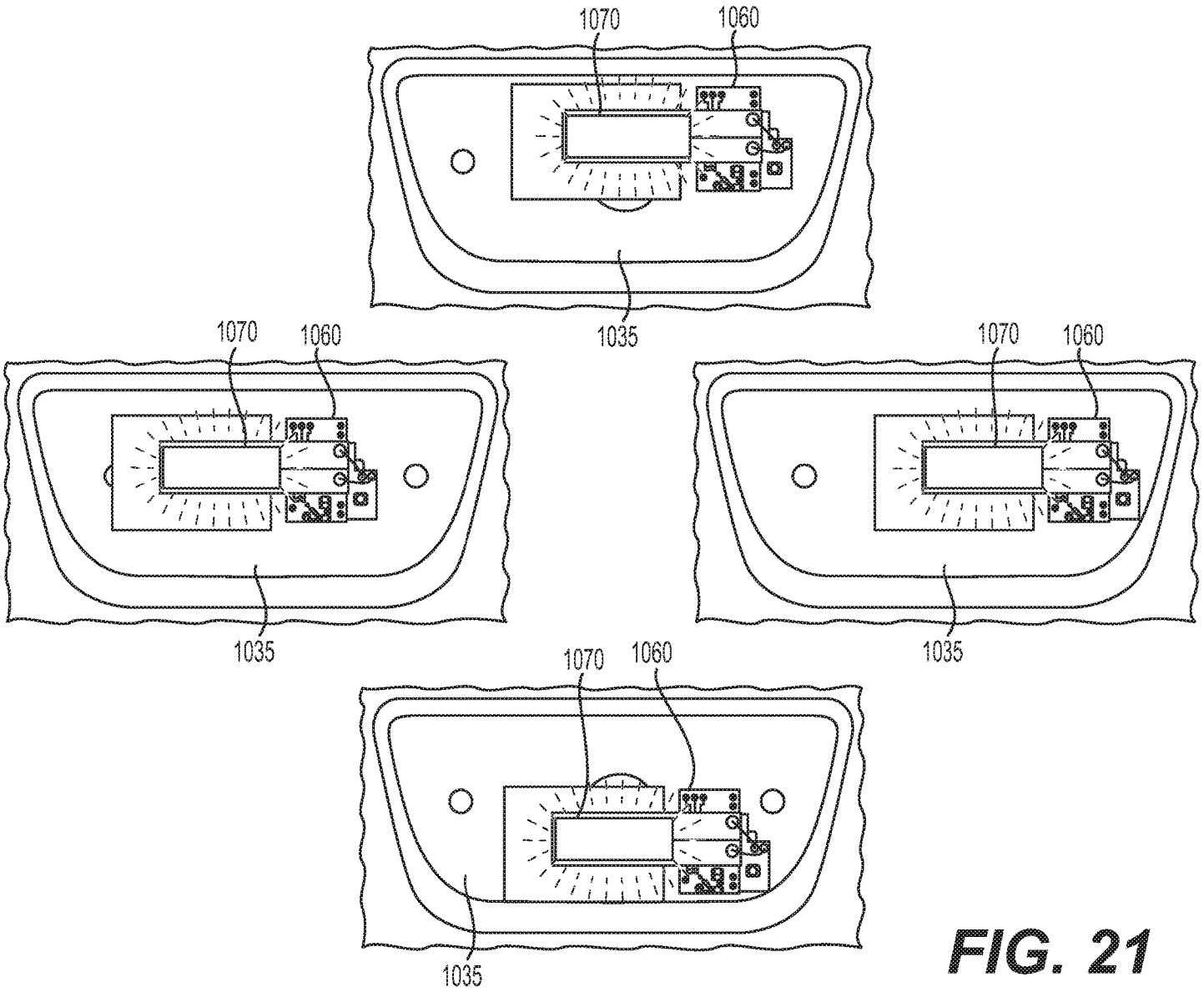
FIG. 21 shows top views illustrating how a light-emitting element can be moved in the X- and Y-directions within a depression in a cab wall without interrupting power from a transmitter board to a receiver coil.

FIG. 21 illustrates how the light-emitting element 1070 can be moved in the X and Y directions within the depression 1035 in the cab wall 1030 without interrupting power from the transmitter board 1020 to the receiver coil 1080.

FIGS. 18-21 show that even if there is some misalignment of the lamp housing 1050 with respect to the depression 1035 in the cab wall 1030, power can still be provided to the light-emitting element 1070 without fail.

In some embodiments, a secondary light can be provided in addition to the light-emitting element 1070. This secondary light can be configured to light up when the receiver coil 1080 receives a set threshold of power or greater. In this way, the secondary light can be used to ensure that the lamp housing 1050 is placed in a location where the receiver coil 1080 will receive sufficient power to run the receiver electronics 1060 and the light-emitting element 1070. Ideally, the lamp housing 1050 will be placed in a location that maximizes the transmitted power.

Alternate embodiments could employ multiple secondary lights configured to light up based on multiple thresholds, with all of the lights lighting at maximum power transmission and fewer lights lighting as respectively lower powers are transmitted.

Alternate embodiments could employ a secondary light that blinks when the receiver coil 1080 receives a set threshold of power or greater. Likewise secondary light or lights of different colors can show when power transmission meets different power thresholds. For example a red light might indicate low-power below a first power threshold, a yellow light might indicate medium power between the first power threshold and a second power threshold, and a green light might indicate high power above the second power threshold.

Alternate embodiments can employ a remote receiver coil with integrated circuit board connected to a modified light-emitting element operating at 5V (or lower).

Alternate embodiments can employ a receiver coil trace on a circuit board with receiver electronics on the other and connected to a light-emitting element.

Alternate embodiments can employ a flexible substrate with a light-emitting element and receiver electronics on the top and copper receiver trace on the bottom.

Alternate embodiments can employ a flexible substrate with a light-emitting element and receiver electronics connected to a remote receiver coil.

CONCLUSION

This disclosure is intended to explain how to fashion and use various embodiments in accordance with the invention rather than to limit the true, intended, and fair scope and spirit thereof. The foregoing description is not intended to be exhaustive or to limit the invention to the precise form disclosed. Modifications or variations are possible in light of the above teachings. The embodiment(s) was chosen and described to provide the best illustration of the principles of the invention and its practical application, and to enable one of ordinary skill in the art to utilize the invention in various embodiments and with various modifications as are suited to the particular use contemplated. All such modifications and variations are within the scope of the invention as determined by the appended claims, as may be amended during the pendency of this application for patent, and all equivalents thereof, when interpreted in accordance with the breadth to which they are fairly, legally, and equitably entitled. The various circuits described above can be implemented in discrete circuits or integrated circuits, as desired by implementation.

What is claimed is:

1. A lighting device, comprising:

a continuous substrate;

a receiver coil trace located directly on the continuous substrate and configured to receive transmitted operational power from a transmitting coil trace;

a light-emitter located directly on the continuous substrate, configured to receive the operational power from the receiver coil trace, the operational power being used to power the light-emitter to generate light; and receiver electronics located directly on the continuous substrate, configured to receive the operational power from the receiver coil trace and to generate control signals to control operation of the light emitter, the operational power being used to power the receiver electronic, wherein the light emitter is located only directly on a first half of a first surface of the continuous substrate, the receiver coil trace is located only directly on a second half of the first surface of the continuous substrate, a ferrite coating is located directly on first and second halves of a second surface opposite the first surface of the continuous substrate, and the continuous substrate is folded in half such that the first half of the second surface of the continuous substrate faces the second half of the second surface of the continuous substrate, the first half of the first surface of the continuous substrate faces in a first direction, and the second half of the first surface of the continuous substrate faces in a second direction opposite the first direction.

2. The device of claim 1, wherein the light emitter is located directly on a first surface of the continuous substrate, the receiver coil trace is located directly on a second surface of the continuous substrate opposite the first surface.

3. The device of claim 2, wherein the receiver electronics are located directly on the first surface of the continuous substrate.

4. The device of claim 2, wherein the receiver electronics are located directly on the second surface of the continuous substrate.

5. The device of claim 1, wherein the receiver electronics are located only directly on the first half of the first surface of the continuous substrate.

6. The device of claim 1, wherein the receiver electronics are located directly on the second surface of the continuous substrate.

7. The device of claim 1, wherein the light emitter is a light-emitting diode.

8. The device of claim 1, wherein the receiver coil trace receives AC power.

9. The device of claim 1, wherein the continuous transmitter substrate is a flexible substrate.

10. The device of claim 1, wherein the transmitting coil trace is located separate from the lighting device.

11. The device of claim 1, wherein the first half of the continuous substrate and the second half of the continuous substrate are connected by a substrate portion that is substantially perpendicular to both the first half of the continuous substrate and the second half of the continuous substrate.

12. A lighting device, comprising:

a continuous transmitter substrate;

a transmitter coil trace located directly on the continuous transmitter substrate;

a continuous receiver substrate;

a receiver coil trace located directly on the continuous receiver substrate and configured to receive transmitted operational power from the transmitting coil trace;

a light-emitter located directly on the continuous receiver substrate, configured to receive the operational power from the receiver coil trace, the operational power being used to power the light-emitter to generate light;

receiver electronics located directly on the continuous receiver substrate, configured to receive the operational power from the receiver coil trace and to generate control signals to control operation of the light emitter, the operational power being used to power the receiver electronics; and a cab wall located between the continuous transmitter substrate and the continuous receiver substrate, the cab wall being unbroken and unpierced.

13. The device of claim 12, further comprising a transmitter housing configured to affix the transmitter circuit board to the cab wall.

14. The device of claim 12, further comprising an affixing material configured to secure the continuous receiver substrate to the cab wall.

15. The device of claim 12, wherein the continuous receiver substrate is a flexible substrate.

16. The device of claim 12, wherein the light emitter is located only directly on a first half of a first surface of the continuous receiver substrate, the receiver coil trace is located only directly on a second half of the first surface of the continuous receiver substrate, a ferrite coating is located directly on first and second halves of a second surface opposite the first surface of the continuous receiver substrate, and the receiver substrate is folded in half such that the first half of the second surface of the receiver substrate faces the second half of the second surface of the continuous receiver substrate, the first half of the first surface of the continuous receiver substrate faces in a first direction, and the second half of the first surface of the continuous receiver substrate faces in a second direction opposite the first direction.

* * * * *